United States Patent [19]

Schlatter et al.

[11] Patent Number: 4,552,008

[45] Date of Patent: Nov. 12, 1985

[54] ROLLING MILL FOR SHEET MATERIAL

[75] Inventors: Beat Schlatter, Mutschellen; Eugen Schnyder, Ottenbach, both of Switzerland

[73] Assignee: Sulzer-Escher Wyss Ltd., Zurich, Switzerland

[21] Appl. No.: 524,331

[22] Filed: Aug. 18, 1983

[30] Foreign Application Priority Data

Aug. 31, 1982 [CH] Switzerland ..... 5297/82

[51] Int. Cl.[4] ..... B21B 31/16

[52] U.S. Cl. ..... 72/243; 72/245

[58] Field of Search ..... 72/241, 243, 245, 201, 72/236, 342, 242; 29/113 AD, 116 AD; 100/162 B, 170

[56] References Cited

U.S. PATENT DOCUMENTS

| | | | |
|---|---|---|---|
| 2,033,046 | 3/1936 | Montgomery | 72/241 |
| 3,523,439 | 8/1970 | Leifeld | 72/241 |
| 4,059,002 | 11/1977 | Rommen et al. | 72/245 |
| 4,059,976 | 11/1977 | Christ et al. | 72/241 |

FOREIGN PATENT DOCUMENTS

| | | | |
|---|---|---|---|
| 59505 | 5/1981 | Japan | 72/243 |
| 17310 | 1/1982 | Japan | 72/243 |
| 2096035 | 10/1982 | United Kingdom . | |

*Primary Examiner*—Lowell A. Larson
*Assistant Examiner*—Jorji M. Griffin
*Attorney, Agent, or Firm*—Robert A. Ostmann

[57] ABSTRACT

A rolling mill for the treatment of sheet material comprises two work rolls (1, 2) which define a nip between which a web of material (3) is passed for rolling. The work rolls (1,2) are offset in a horizontal direction relatively to back-up rolls (4,5), so that the plane containing the axes (A,A) extends parallel to but offset relative to the plane containing the axes (B,B) of the back-up rolls (4,5). Supporting devices (9) are associated with the work rolls (1,2) and support the work rolls in the direction opposite to that in which they are offset from the back up rolls. The supporting devices (9) comprise hydrostatic supporting elements (19,20,21) which are arranged parallel to the longitudinal axis (A) of the work rolls (1,2) and comprise hydrostatic pressure pockets (29) which face towards the surfaces being supported in each case and can be individually controllable. The work rolls (1,2) with the supporting devices (9) associated therewith can be arranged in the rolling mill stand for horizontal displacement generally parallel to the web of material (3).

9 Claims, 8 Drawing Figures

ROLLING MILL FOR SHEET MATERIAL

BACKGROUND TO THE INVENTION

The invention relates to rolling mills for sheet material normally in the form of a continuous band or web, in which two work rolls define a nip between which the material to be processed is guided. Such mills also usually include one or more back-up rolls associated with each work roll. In mills of the type to which the present invention relates, the plane containing the axes of the work rolls is offset relative to the plane containing the axes of the back-up rolls, and the work rolls are supported against the direction of offset from the back up rolls.

Rolling mills of this kind, which are described for example in U.S. Pat. No. 4,059,976, have considerable advantages over the usual four-high arrangement wherein the axes of the work rolls and of the back-up rolls are situated in one vertical plane, particularly when thin metal sheeting is being rolled, such as thin aluminium foils. Where the foil thickness is for example 0.1 mm, owing to the elasticity of the system it is impossible, when deflection of the rolls occurs, to apply working pressure of a specific quality uniformly over the entirety of the roll gap. Supporting devices can counteract the elastic deflection phenomena of the roll system. In one known construction; e.g., in rolling mills produced under the name MKW (multipurpose cold rolling mill) by the German firm of Schloemann Siemag AG., a system of bearing rolls is provided which accepts the load of the work roll in the horizontal direction and with which the deflections of the work roll in the horizontal direction can also be corrected. In certain cases this can be done by preloading or by convexing the rolls.

Rolling mills of this kind are operable in both possible rolling directions, in each case by reversal of the direction of rotation of the rolls. But the circumstances and the components of force vary in the respective individual rolling or rotation directions, so that the rolling mill has to be suitably adaptable or adjustable to the particular rolling programme to be carried out; i.e., both when changing the rolling direction and also when making corrections during a pass. With present-day rolling mills, problems arise more particularly in connection with such supporting devices and their adjustability. Mechanical friction occurs between the component parts, and such friction phenomena vary with the forces applied. Further, marking can develop, of which traces may be reproduced as far as on to the often highly polished rolling surfaces of the work rolls. Thus work rolls supported by such mechanisms are subject to additional wear.

SUMMARY OF THE INVENTION

The present invention is a development of rolling mills of the type just described, and seeks to facilitate not only the construction of the mill, but also adjustment of the mill once it is installed. Means are provided by which mechanical friction between the parts which are to be under load can be minimized or eliminated, and the working life of such parts thereby extended. Provision is also made for cooling systems of various forms, also to minimized wear and damage through overheating.

According to the invention, a rolling mill comprises a roll stand with two work rolls defining a nip therebetween for passage of sheet material to be rolled, and displaceable in a direction generally parallel to the path of such sheet material through the nip; a back up roll associated with each work roll, all the rolls being rotatable on parallel axes, but the plane containing the back up roll axes being offset from that containing the work roll axes; and support devices for supporting the work rolls against movement away from the plane of the back up roll axes and against the surfaces thereof to apply pressure on a sheet material in said nip, which devices comprise hydrostatic elements arranged parallel to the respective work roll axis. The supporting devices can be controlled, for example individually or in groups, to enable non uniform deflections of the work rolls to be accommodated and counteracted.

At least one, normally each, of the back up rolls is preferably a deflection compensation roll comprising a roll shell rotatably mounted on a support by means of support members adjustable to maintain the line of action of the support members in the plane containing the axes of the respective work and back up rolls. Deflection compensation, or adjustment rolls can also be used in the support devices. In an alternative arrangement, the support devices act on the external surface of a supported roll. The devices may act directly on the work rolls, or through one or more intermediate rolls. The hydrostatic elements define pockets acting on a supported surface and are arranged parallel to the longitudinal axis of the respective work roll. They are controllable, and the work rolls are normally displaceable in the direction of rolling to enable not only the effective use of the support devices but also to accommodate different rolling processes.

Because of the measures proposed by the present invention, construction of the rolling mill is simplified, since it is possible to let the hydrostatic supporting elements act directly or indirectly on the surface which is to be supported or is subject to load. With a film of fluid present, no damaging friction comes to occur between the supported surface and the supporting elements. The force to be applied against the surface can be hydraulically regulated precisely and simply as regards magnitude and location. It is possible not only simply to support the work roll linearly but also to load the work roll differently by individual elements, in order; e.g., to bring about a greater working pressure in the middle of the roll gap than at the side regions of the gap. This is possible even if for space reasons; e.g., in the case of very thin work rolls, one or more intermediate rolls have to be arranged between the work roll and the supporting elements. By eliminating damaging friction phenomena the working life of the rolling mill is prolonged, and this is likewise promoted by the fact that by means of the film of fluid the surfaces may be cooled when necessary.

In one preferred embodiment, the elements of the support devices each comprise an head portion which defines said pockets and a body with respect to which the head portion is slidingly mounted; and a drawing device for moving the head portion away from said supported roll to permit greater flow of hydraulic fluid through the element. This enhances cooling and is particularly effective when the support devices act on the external surface of a roll. Another means by which the hydraulic fluid may be used for additional cooling is by making provision for controlled leakage of fluid from the element onto the working parts or onto the sheet material being rolled.

Embodiments of the invention will now be described by way of example and with reference to the accompanying schematic drawings. It will be appreciated that various of the features illustrated in one embodiment can be used to advantage also in others.

DESCRIPTION OF THE PREFERRED EMBODIMENTS

Figure 1:
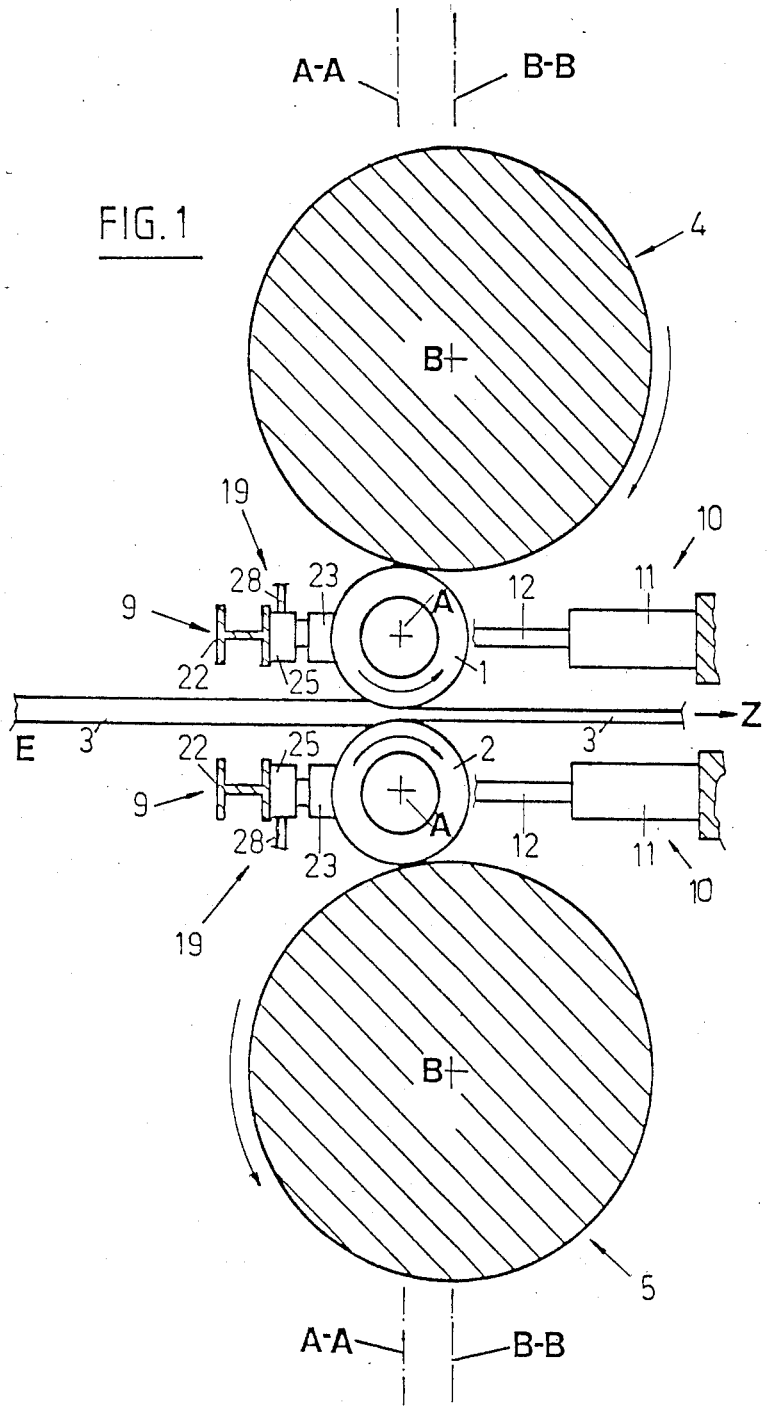
FIG. 1 is a side view in partial cross-section of two work rolls, two back-up rolls and supporting devices in a rolling mill according to the invention.

The rolling mills shown diagrammatically in FIGS. 1 to 6 each comprise two work rolls 1 and 2, between which a web of material 3 is conducted from an entry side (the left as shown) of the rolling mill for rolling. The work rolls 1 and 2 are driven, respectively in the directions shown by the arrows in the drawings. Their axes are designated as A in the drawings. Accordingly, the web of material 3 moves between the work rolls 1 and 2 and is drawn away, treated, at the exit side of the rolling mill (the right as shown) with the use of a force Z. To load each work roll 1 and 2 respectively with a working pressure in the direction towards the web of material 3 back up rolls 4 and 5 respectively are associated one with each work roll. In the constructional example according to FIG. 1 the back up rolls 4 and 5 are driven solid rolls, so that the work rolls 1 and 2 are entrained and thus driven by friction without slip by the back up rolls. By reversing the driving direction the rolling mill can also operate in the reverse direction. To load the work rolls, the axles of the back up rolls are loaded in the direction towards the material web.

In the other embodiments shown in FIGS. 2 to 6 the back up rolls 4 and 5 are constructed as deflection adjustment or compensation rolls (known per se), with a stationary support member 6 which is secured in the stand (not shown) of the rolling mill and about which there is arranged a rotatably roll shell 7 which bears by means of supporting elements 8 on the support member 6. The supporting elements 8 are incorporated like pistons in the support member, arranged in a row parallel to the axis of the support member 6, and hydraulically operated, so that the working pressure to be applied acts from the support member 6 via the supporting elements 8 and the roll shell 7 on the work roll 1 or 2. When using deflection adjustment rolls as back up rolls it is more practical for the work rolls 1 and 2 to be driven direct through their axles.

The work rolls 1 and 2 and the back up rolls 4 and 5 are so positioned that the plane A—A containing the axes A,A of the work rolls 1 and 2 is offset in a horizontal direction, towards the left as shown, relative to the plane B—B containing the axes B,B of the back up rolls 4 and 5.

With this arrangement and force transmission system, the work rolls tend to yield under working load, resulting for example in deflection of the rolls in a horizontal direction. To counteract this tendency, the work rolls are supported laterally with supporting devices 9. The supporting devices 9 are so associated with the work rolls 1 and 2 that they support the work rolls in the direction oppositely to the direction of offset. Thus in the illustrated constructional examples they are arranged on the left of the work rolls, since here the work rolls are offset towards the left relative to the back-up rolls.

The supporting devices 9 comprise hydrostatic supporting elements 19 or 20 or 21 respectively, which are arranged in the supporting device parallel to the longitudinal axis of the respective work roll 1 or 2 which is being supported, and have hydrostatic pressure pockets or channels 29 which are open towards the surface being supported and are directed towards said surface. The surface to be supported is for example in the case of the embodiments of FIGS. 2, 4, 5 and 6 the cylindrical surface of the work roll 1 or 2.

Figure 3:
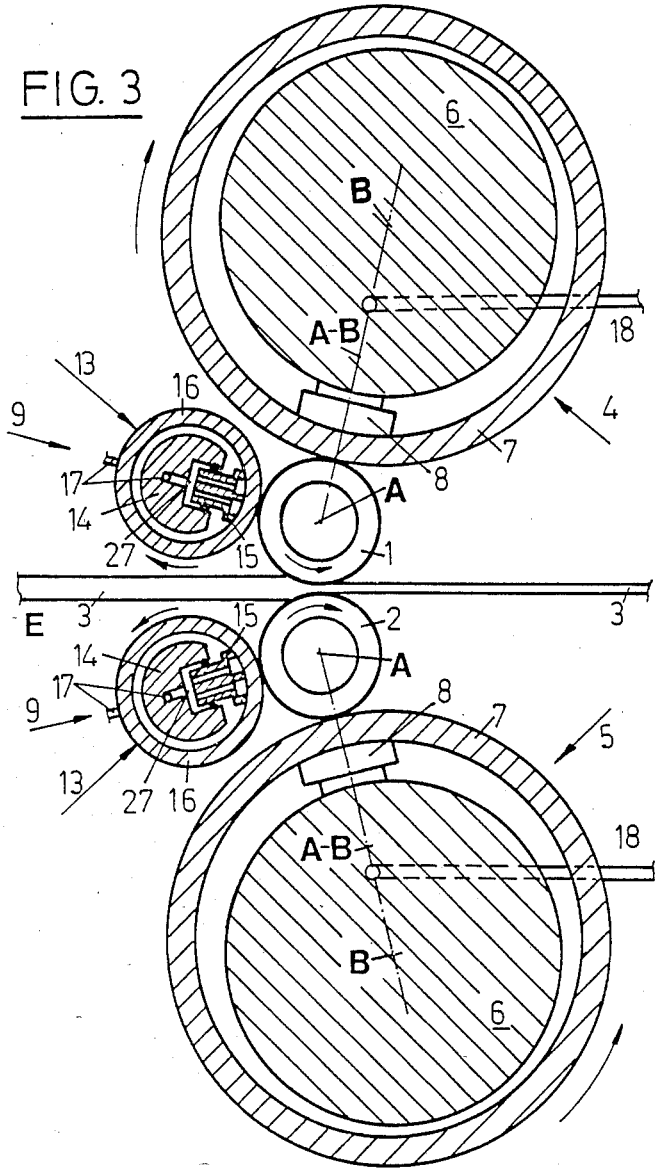

In the embodiment of FIG. 3 the surface to be supported is the inner surface of the roll shell 16 of a deflection adjustment roll 13 used here in the supporting device. The supporting element in this case is designated 15. If necessary a plurality of parallel-arranged intermediate rolls 45 may or have to be arranged in between a work roll, particularly if it is of a small diameter, and the supporting device or elements. Then a surface to be supported is the cylindrical surface of an intermediate roll 45 (see FIG. 1) which abuts on the supporting elements. For the sake of simplicity such intermediate rolls which may be provided are shown only in FIG. 1.

The work rolls 1 and 2 with the associated supporting devices 9 are arranged in the stand (not shown) of the rolling mill to be displaceable horizontally and generally parallel to the web of material 3. This serves inter alia for adapting the rolling mill for different processing tasks and for different material webs. Thus it is possible in accordance with the needs of the particular processing task to shift the aforesaid plane A—A; i.e., the work rolls 1 and 2 relatively to the aforesaid plane B—B; i.e., relatively to the back-up rolls 4 and 5 and thus to provide appropriate or desired force conditions. To shift the work rolls 1 and 2, shifting units 10 (see FIG. 1) are provided which bear on the one hand on the stand of the rolling mill and on the other hand engage on shafts of the displaceably mounted work rolls 1 and 2, in order to enable displacement of the work rolls with the associated supporting devices 9 generally parallel to the path of the material web 3. They may be servomotors 11 as in this embodiment, connected by means of their actuating rods 12 to the shafts of the work rolls 1 and 2.

For the fully effective provision or utilisation of the desired force conditions it is also important that the support members 6 of the back up rolls 4 and 5, when constructed as deflection adjustment rolls with supporting elements 8, are adjustably mounted in the stand. The support member 6 of the back up roll 4 or 5 as the case may be, in which supporting elements 8 are arranged in a row extending parallel to the axis of said support member, can be rotated in its bearing arrangement and can thus turn to a position in which the axis B of the support member 6, the longitudinal axes of the supporting elements 8 and the axis A of the work roll 1 or 2 which is associated with the back up roll 4 or 5 respectively and is offset oppositely to the direction of travel of the material web 3, are situated in a common plane A–B.

Figure 2:
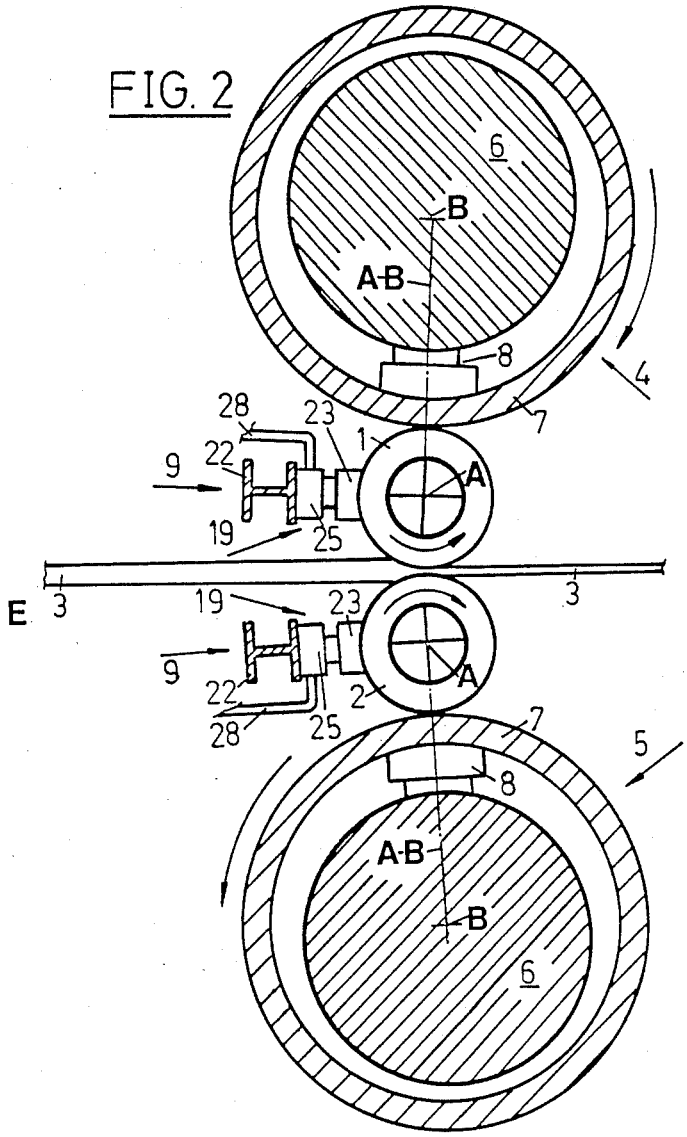
FIGS. 2 to 6 are each views similar to that of FIG. 1, but illustrating further embodiments of the invention.

This advantageous position, in which the pressure application force is transmitted from the support member 6 via the supporting elements 8 to the roll cylinder or shell 7 to the work roll 1 or 2 respectively most effectively, is shown particularly clearly in FIGS. 2 and 3.

According to FIG. 3, deflection adjustment rolls 13 are provided as supporting devices 9 laterally of the work rolls 1 and 2. They comprise stationary support members 14 in which supporting elements 15 are embedded in piston-like manner, and a roll shell 16 is arranged to be capable of rotating about the support member. A fluid under pressure is fed through conduits 17 to the supporting elements 15. A pressure fluid is fed through conduits 18 to the supporting elements 8 of the back up rolls 4 and 5 respectively.

In the embodiments shown in the other FIGS. 1, 2 and 4 to 6, hydraulic supporting elements 19 (FIGS. 1, 2 and 6), 20 (FIG. 4), and 21 (FIG. 5) are provided in the supporting devices 9.

Supporting devices 9 with such supporting elements 19 or 20 or 21 respectively are used when in the case of a particular processing operation the work rolls 1 and 2 have to be cooled to an increased extent, possibly through the agency of intermediate rolls which may also be provided. The supporting elements are secured on a support beam 22 supported on the stand of the rolling mill and arranged in a row parallel to the axis of the associated work roll 1 or 2, and thus support the work roll laterally. A fluid under pressure flows through the head parts 23 and 24 respectively of the supporting elements out on to the supported work roll, with a cooling effect. The head parts 23 and 24 are embedded in the manner of pistons in bodies 25 of the supporting elements. Provided in the body 25, below the head part, is a pressure chamber 27 into which a pressure fluid is introduced through a conduit 28. The head part is pressed towards the work roll to support the roll with the force which is produced in the pressure chamber 27. The head part comprises at least one pressure pocket 29 which is open towards the work roll and in which an hydraulic pressure cushion is built up, and from which the pressure fluid flows out continually on to the work roll. The pressure fluid flows in conventional manner from the pressure chamber 27 through ducts 30 into the pressure pockets 29 and out of these on to the work roll, cooling it.

Figure 4:
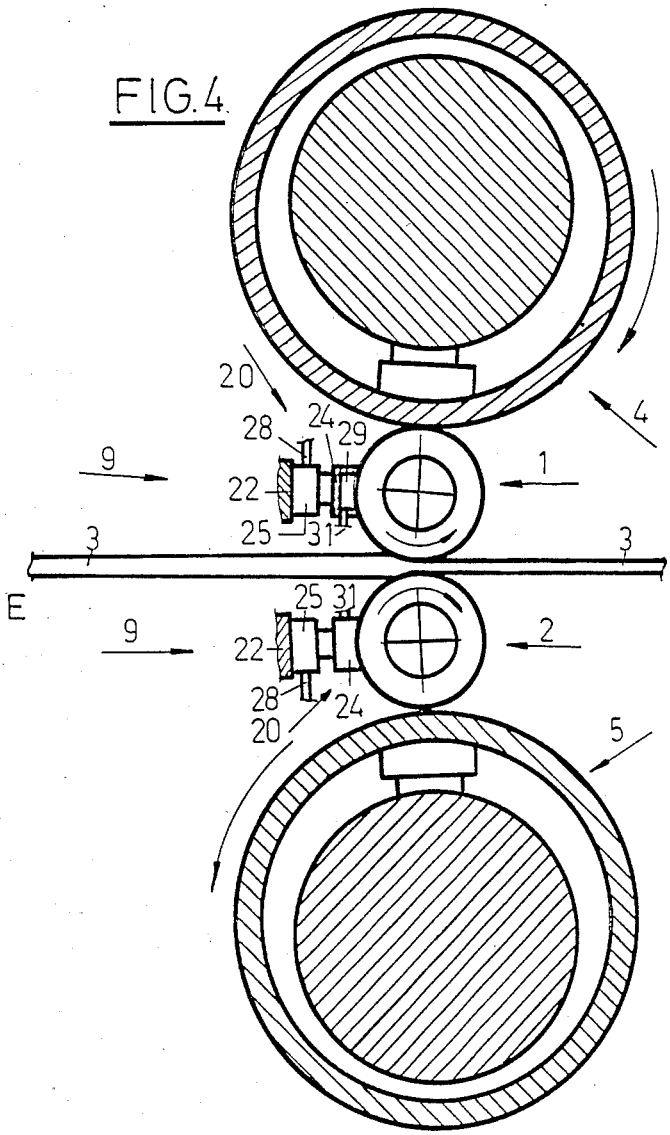
Figure 7:
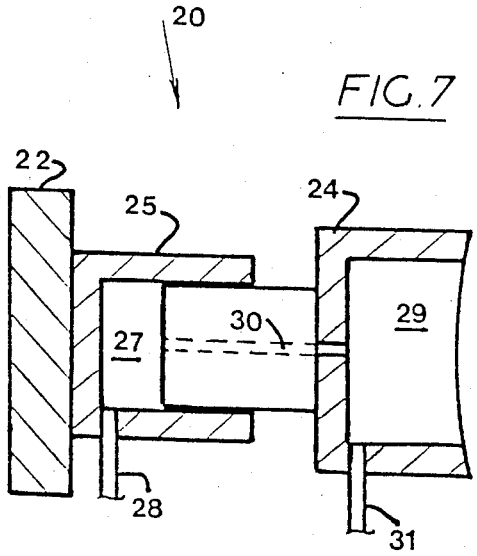
FIG. 7 is a sectional view of a supporting element from the embodiment of FIG. 4 to a larger scale.

To increase the throughflow of pressure fluid through the head part; i.e., to increase the cooling effect, it is proposed as shown in FIG. 4 and 7 to arrange a conduit 31 for the pressure fluid to debouch into the pressure pocket 29, so that the throughflow can be regulated, by controlling the passage of fluid through conduit 31, in accordance with cooling requirements.

Figure 5:
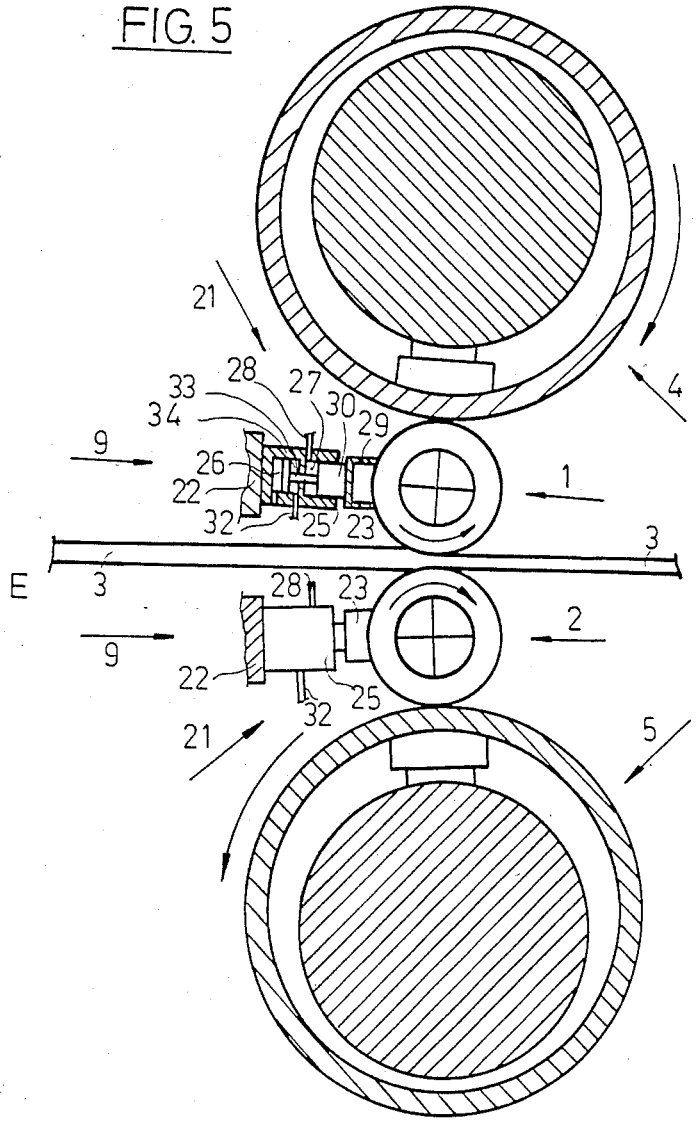
Figure 8:
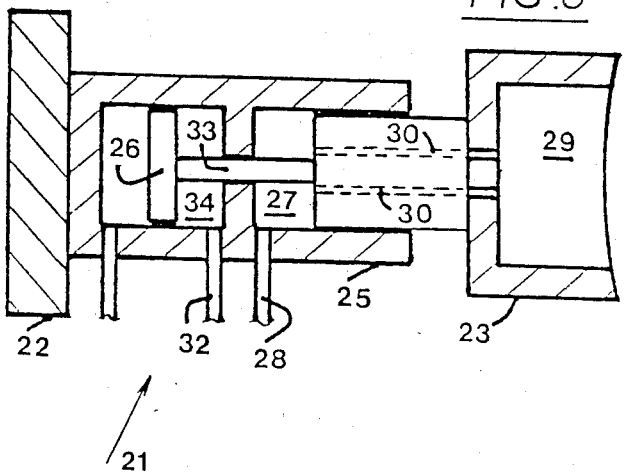
FIG. 8 is a sectional view of a supporting element from the embodiment of FIG. 5 to a larger scale.

Again for the purpose of increasing the throughflow of pressure fluid towards the work roll, a drawing device can be provided, as shown in FIG. 5 and 8 which acts oppositely to the direction of the pressure application force shifting the head part 23 in the pressure chamber 27. Below the pressure chamber 27 there is also provided a cylinder-like pressure chamber 34 in which a piston 26 is arranged. This piston 26 is connected to the head part 23 by means of a draw rod 33. A fluid under pressure is introduced into the pressure chamber 34 through a conduit 32. The force produced in this pressure chamber 34 acts on the piston 26 and via the rod 33 on the head part 23 oppositely to the pressure application force which acts on the head part 23 in the pressure chamber 27 with a displacing effect. As a result a greater distance is produced between the head part 23 and the work roll 1 or 2, and also a greater pressure in the pressure chamber 27, so that more pressure fluid flows out through the ducts 30 and through the pressure channel 29 on to the work roll.

Figure 6:
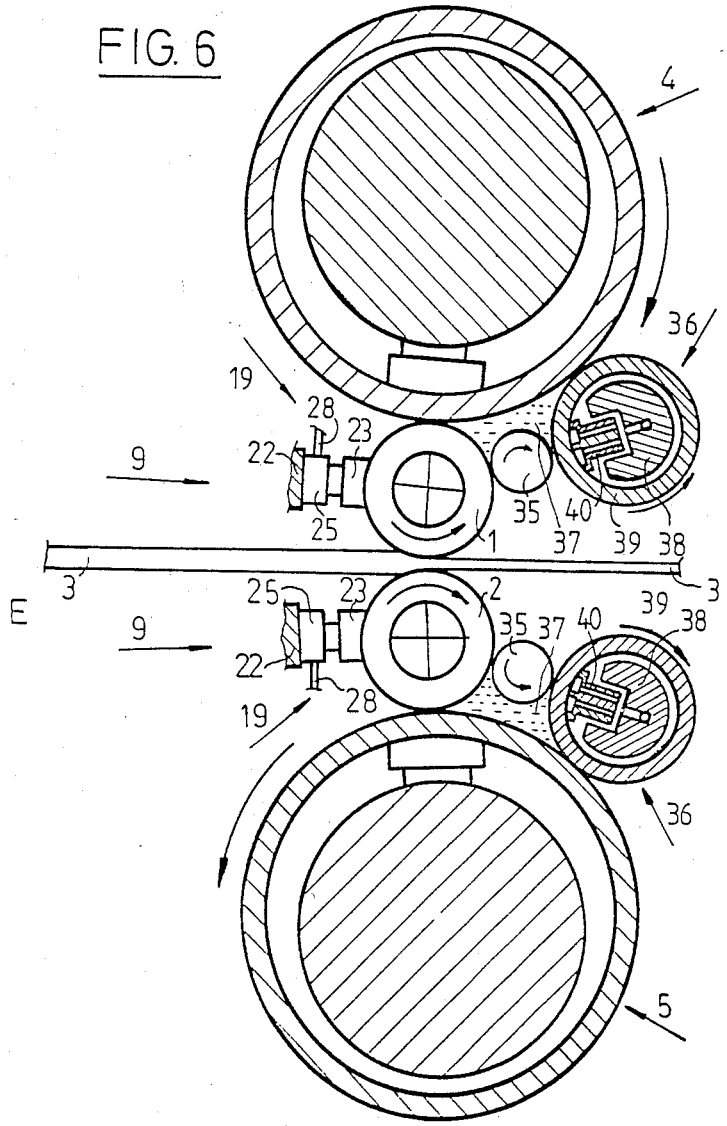

When there is an additional need for cooling for the work rolls land 2 a cooling device is provided as shown in FIG. 6 at the outlet side of the rolling mill relatively to the direction in which the web of material moves; i.e., on the right as shown. The device comprises a first limiting roll 35 arranged to abut on the work roll 1 or 2 with a spacing from the shell 7 of the back up roll 4 or 5, and a second limiting roll 36 which abuts on the first limiting roll 35 and on the shell 7 of the back up roll 4 or 5. Thus the limiting rolls 35 and 36, the work rolls 1 and 2 respectively and the shells 7 of the back up rolls 4 and 5 respectively in each case form the boundaries of a cooling chamber 37 which is filled with cooling medium. Each cooling chamber 37 is provided at each end with a sealing apron (not shown). Advantageously the first limiting roll 35 has a flexible roll shaft which is surrounded by an elastic jacket; e.g., a rubber jacket, and the second limiting roll 36 is constructed as a deflection adjustment roll, with an elastic roll shell 39 which is arranged to be rotatable about a stationary support member 38 and bears on the support member 38 by means of supporting elements 40. In this way the cooling chamber 37 can be reliably sealed by means of the limiting rolls. The limiting rolls 35 and 36, and also the shells 7 of the back up rolls 4 and 5, are driven by friction through the driven work rolls 1 and 2 and through the back up rolls, respectively.

Advantageously the supporting elements 19, 20, 21 used in the supporting devices 9, and 15 in the deflection adjustment roll 13 in FIG. 3 are regulatable individually or in groups, to allow of producing varying magnitudes of working pressure in the rolling gap between the work rolls 1 and 2. More particularly for the flattening of very thin foils which have to be produced it is sometimes necessary to use a higher working pressure in the middle of the rolling gap than at the sides of the gap. Previously this has been achieved by for example, giving the rolls concerned a convexity which has been predetermined from experience. A desirable rolling gap profile for rolling purposes can now be adjusted hydraulically. Owing to the film of fluid provided between the supporting elements and the surfaces being supported the; e.g., polished surfaces are not worn or damaged by metal contact.

The rolling mill according to the invention allows a web of material to be processed in an alternating manner. In that case the material web is rolled in one direction through the rolling mill and then rolled back again in the opposite direction. Since different force conditions obtain in each of the two directions, or different working pressures have to be used, the good regulating ability of the hydraulically operated supporting elements is a significant advantage.

FIG. 7 shows one of the supporting elements 9 of FIG. 4 on a larger scale, using the same reference numerals.

FIG. 8 shows similarly and again on a larger scale one of the supporting elements 19 which is shown in FIG. 5.

We claim:

1. A rolling mill comprising a roll stand having two work rolls defining a nip for passage of sheet material to be rolled, and a back up roll associated with each work roll; all of the rolls being rotatable on parallel axes, with the axes of the work rolls lying in a plane offset from the plane containing the axes of the back up rolls; a support device associated with each work roll and including hydrostatic elements which are arranged parallel with the work roll axis and urge the work roll against the associated back up roll to apply pressure on sheet material in the nip; the work rolls and the supporting devices being displaceable in the stand relatively to the back up rolls in a direction generally parallel with the path of sheet material through the nip; positioning means acting on both the work rolls and the support devices for adjusting the position of these parts in said displacement direction to thereby alter the spacing between the plane containing the axes of the work rolls and the plane containing the axes of the back up rolls and adapt the mill to the needs of a particular rolling process; and at least one of the back up rolls being a deflection compensation roll comprising a roll shell which rotates about a support member and is carried by hydraulically operated supporting elements arranged in the support member in a row parallel with the axis thereof, the support member being mounted in the stand for rotational adjustment about its axis so that the line of action of the supporting element can be kept in the plane containing the axes of the support member and the associated work roll regardless of alterations in the spacing between the planes containing the work roll axes and the back up roll axes effected by the positioning means.

2. A rolling mill according to claim 1, wherein the support devices comprise deflection adjustment rolls with controllable supporting elements.

3. A rolling mill according to claim 2 wherein the deflection adjustment rolls act directly on the respective work rolls.

4. A rolling mill according to claim 2 or claim 7 including at least one intermediate roll between a respective work roll and supporting device.

5. A rolling mill according to claim 1, wherein the support devices comprise elements defining hydrostatic pockets acting on the external surface of a supported roll.

6. A rolling mill according to claim 5 wherein said pockets act directly on a respective work roll.

7. A rolling mill according to claim 5 or claim 6 wherein the elements each comprise an head portion which defines said pockets and a body with respect to which the head portion is slidingly mounted; and a drawing device for moving the head portion away from said supported roll to permit greater flow of hydraulic fluid through the element.

8. A rolling mill according to claim 5 or claim 6 wherein the support devices include pressure chambers for said elements, outlet conduits leading from the chambers to the pockets to enable a cooling fluid to flow through the elements while maintaining a requisite hydrostatic pressure in said pockets, and additional conduits for leading cooling fluid into said pockets.

9. A rolling mill according to claim 1 including two pairs of limit rolls on the same side of the work rolls as the plane of the back up roll axes, each pair of limit rolls having elastic surfaces cooperating with a respective work roll and back up roll to define a chamber for containing a cooling medium.

* * * * *